United States Patent [19]

Hart

[11] 3,947,926

[45] Apr. 6, 1976

[54] WEATHER BOARD RECORDER

[75] Inventor: James H. Hart, Monroe, N.Y.

[73] Assignee: The Raymond Lee Organization, Inc., New York, N.Y. ; a part interest

[22] Filed: Apr. 28, 1975

[21] Appl. No.: 572,202

[52] U.S. Cl. ..... 24/67.3; 240/6.4 B

[51] Int. Cl.[2] ..... F21V 33/00

[58] Field of Search..... 24/67 R, 67.3, 67.5, 67.7; 128/1 B; 346/20; 108/23, 43; 240/2 P, 6.4 B

[56] References Cited

UNITED STATES PATENTS

| | | | |
|---|---|---|---|
| 992,222 | 5/1911 | Maben | 240/2 P |
| 1,889,373 | 11/1932 | Pereira | 240/6.4 B |
| 2,516,239 | 7/1950 | Moss | 24/67.3 UX |
| 2,539,900 | 1/1951 | Duffy | 128/1 B |
| 2,600,240 | 6/1952 | Grieb | 128/1 B |
| 2,685,638 | 8/1954 | Littrell | 240/6.4 B |
| 2,806,715 | 9/1957 | Smith | 240/6.4 B X |
| 3,092,335 | 6/1963 | Wilson | 240/6.4 B |
| 3,808,415 | 4/1974 | Hurst | 240/6.4 B X |

*Primary Examiner*—Donald A. Griffin
*Attorney, Agent, or Firm*—Daniel Jay Tick

[57] ABSTRACT

A weather board recorder comprises a base member having a weather gasket therearound. A cover member is hingedly affixed to the base member for selectively providing access to the inner surface of the base member. A latch on the base member releasably secures the cover member to the base member. A clip board rests on the inner surface of the base member. A clip device on the base member retains the clip board thereon. A reflector is mounted on the base member in the area of the head of the clip board. A lamp is mounted on the base member in operative proximity with the reflector for illuminating the clip board. A battery is mounted on the base member and is electrically connected to the lamp for energizing the lamp. A hole is formed through the top of the cover member. A viewer is mounted on the cover member in the hole for providing a view of the clip board.

4 Claims, 4 Drawing Figures

WEATHER BOARD RECORDER

DESCRIPTION OF THE INVENTION

The present invention relates to a weather board recorder.

Objects of the invention are to provide a weather board recorder of simple structure, which is inexpensive in manufacture, and functions efficiently, effectively and reliably to permit the manual collection of data by writing on a clip board under all kinds of difficult and trying weather conditions such as, for example, driving rain, heavy snow and sleet, temperatures below zero and areas outside buildings above the tenth story. The weather board recorder of the invention eliminates messy, illegible and ruined records written under adverse weather conditions and eliminates the need for the operator to carry a flashlight in one hand and a soaked clip board in the other. It also eliminates the need for the operator to grope for a pencil or to look at a soaked and streaming wrist watch.

In order that the invention may be readily carried into effect, it will now be described with reference to the accompanying drawing, wherein.

In the FIGS., the same components are identified by the same reference numerals.

Figure 1:
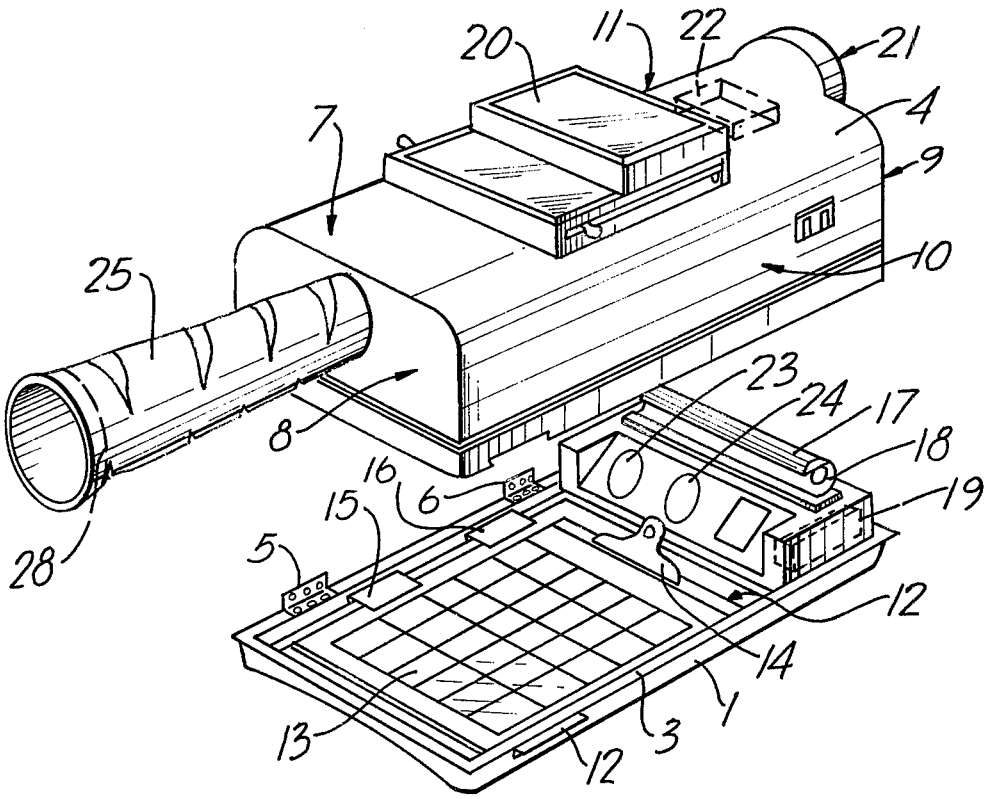
FIG. 1 is a perspective view of an embodiment of the weather board recorder of the invention with the base member and cover member separated from each other.
Figure 3:
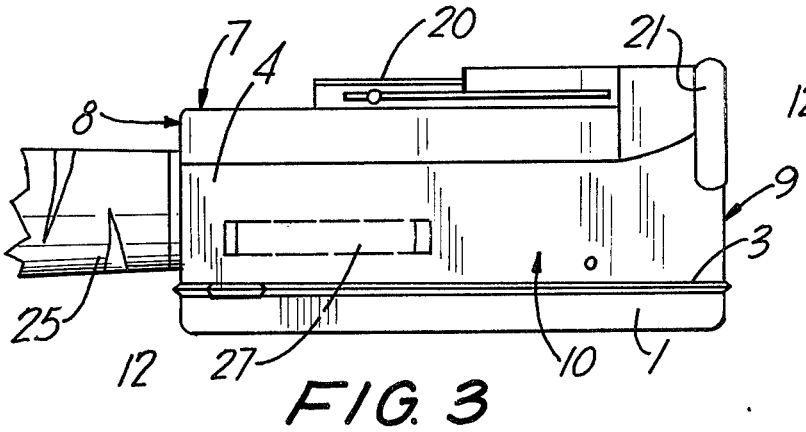
FIG. 3 is a view, taken along the lines III—III, of FIG. 2.
Figure 4:
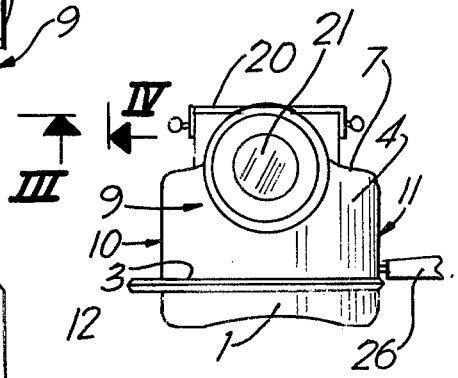
FIG. 4 is a view, taken along the lines IV—IV, of FIG. 2.

The weather board recorder of the invention comprises a base member 1 (FIGS. 1, 3 and 4) having an inner surface 2 (FIG. 1).

A weather gasket 3 (FIGS. 1, 3 and 4) is provided around the base member 1.

A cover member 4 is hingedly affixed to the base member 1 by any suitable means such as, for example, hinges 5 and 6 (FIG. 1) for selectively providing access to the inner surface 2 of the base member 1. The cover member 4 has a top 7 and sides 8, 9, 10 and 11.

A latch 12 is provided on the base member 1 for releasably securing the cover member 4 to the base member.

A clip board 13 (FIG. 1) rests on the inner surface 2 of the base member 1. The clip board has a head 14 (FIG. 1).

Clip devices 15 and 16 (FIG. 1) on the base member 1 retain the clip board 13 thereon.

A reflector 17 (FIG. 1) is mounted on the base member 1 in the area of the head 14 of the clip board 13. A lamp 18 is mounted on the base member 1 in operative proximity with the reflector 17 (FIG. 1) for illuminating the clip board 13. A battery or batteries 19 (FIG. 1) of any suitable type are mounted on the base member 1 and are electrically connected to the lamp 18 for energizing said lamp.

A hole is formed through the top 7 of the cover member 4 and a viewer 20 is mounted on the cover member over the hole for providing a view of the clip board 13. The viewer 20 comprises any suitable transparent material such as, for example, clear plastic.

A second hole is formed through the side 9 of the cover member 4. A head lamp 21 is mounted in the second hole. A battery or batteries 22 (FIG. 1) of any suitable type are mounted in the cover member and are electrically connected to the head lamp 21 for energizing said head lamp.

Watches or clocks 23 and 24 (FIG. 1) are mounted on the base member 1 in proximity with the lamp 18.

Figure 2:
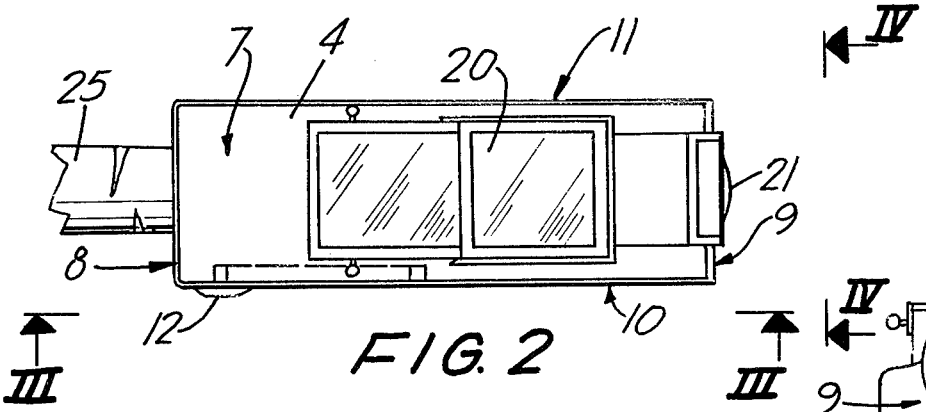
FIG. 2 is a top view of the embodiment of FIG. 1.

A third hole is formed through the side 8 of the cover member 4. A flexible sleeve 25 (FIGS. 1 to 3) of any suitable material such as, for example, plastic, extends from the third hole to provide access to the clip board 13 of an arm and hand of a user.

In order to operate the weather board recorder of the invention, the user places the base member 1 on his knee, while in seated position, bends his head down over the viewer 20, slips his hand and arm into the unit via the sleeve 25 and proceeds to write his data on paper clipped to the clip board 13. A handle 26 (FIG. 4) is provided on either side 10 or 11 of the cover member 4, so that it may be grasped by the free hand of the user while he is writing with his other hand. A carrying handle 27 (FIG. 3) is affixed to the side 10 of the cover member 4.

A flameless catalyst heater, of any suitable known type, is provided inside the cover member 4. The lamp 18, the head lamp 21 and the heater are shrouded in a manner whereby they are free from sparking in a methane air mixture, so that they meet the standards of the Bureau of Mines of the United States Department of the Interior.

The base member 1 and the cover member 4 consist of sturdy and tough light plastic material, which is preferably light in color so that it is suitable for night work.

The sleeve 25 preferably has an elastic band 28 (FIG. 1) at its free end, so that it clings to the sleeve of the user.

While the invention has been described by means of a specific example and in a specific embodiment, I do not wish to be limited thereto, for obvious modifications will occur to those skilled in the art without departing from the spirit and scope of the invention.

I claim:

1. A weather board recorder, comprising
   - a base member having an inner surface;
   - a weather gasket around the base member;
   - a cover member hingedly affixed to the base member for selectively providing access to the inner surface of the base member, said cover member having a top and sides;
   - latch means on the base member for releasably securing the cover member to the base member;
   - a clip board resting on the inner surface of the base member, said clip board having a head;
   - clip means on the base member for retaining the clip board thereon;
   - reflector means mounted on the base member in the area of the head of the clip board;
   - lamp means mounted on the base member in operative proximity with the reflector means for illuminating the clip board;
   - battery means mounted on the base member and electrically connected to the lamp means for energizing said lamp means;
   - there being a hole formed through the top of the cover member; and
   - viewer means mounted on the cover member over the hole for providing a view of the clip board.

2. A weather board recorder as claimed in claim 1, further comprising a second hole formed through a first side of the cover member, a head lamp mounted in the second hole and battery means mounted in the cover member and electrically connected to the head lamp for energizing said head lamp.

3. A weather board recorder as claimed in claim 2, further comprising a third hole formed through a second side of the cover member and a flexible sleeve extending from said third hole to provide access to the clip board of an arm and hand of a user.

4. A weather board recorder as claimed in claim 1, further comprising watches mounted on the base member in proximity with the lamp means.

* * * * *